United States Patent [19]

Forsell

[11] 4,042,021

[45] Aug. 16, 1977

[54] CONNECTION BETWEEN WATER TUBES

[75] Inventor: Bror Ingvar Forsell, Goteborg, Sweden

[73] Assignee: RP Rorprodukter AB, Goteborg, Sweden

[21] Appl. No.: 677,540

[22] Filed: Apr. 16, 1976

[30] Foreign Application Priority Data

May 7, 1975 Sweden ..... 7505328
Mar. 29, 1976 Sweden ..... 7603739

[51] Int. Cl.[2] ..... E21B 33/03
[52] U.S. Cl. ..... 166/85; 166/88
[58] Field of Search ..... 166/85, 88, 72; 285/106, 199

[56] References Cited

U.S. PATENT DOCUMENTS

| | | | |
|---|---|---|---|
| 2,949,961 | 8/1960 | Anderson | 166/85 |
| 2,998,847 | 9/1961 | Maass | 166/85 |
| 3,430,697 | 3/1969 | Wellstein | 166/85 |
| 3,561,796 | 2/1971 | Williams | 166/85 |
| 3,722,586 | 3/1973 | Baker | 166/85 |

*Primary Examiner*—James A. Leppink
*Attorney, Agent, or Firm*—Harness, Dickey & Pierce

[57] ABSTRACT

A coupling arrangement to removably interconnect pipes in a well, below ground level. The coupling comprises a head with a lateral connecting branch intended to sealingly engage a seat formed on the water pipe leading to the pump. An actuating rod with an eccentric thereon is rotatably mounted on said coupling head, said eccentric is arranged, when turned in one direction by the rod to displace said coupling head laterally until the connecting branch thereon engages in said seat, and when turned in the opposite direction, to effect disengagement between said seat and said connecting branch on said coupling head.

7 Claims, 9 Drawing Figures

CONNECTION BETWEEN WATER TUBES

BACKGROUND OF THE INVENTION

In well installations of the kind where an ascending pipe through which the water in the well rises, is arranged to be connected via a pipe coupling to a pipe, deposited in the ground below freezing level and leading to a pump, it is common practice to provide a knee pipe joint at the lower end, inside some cement rings stacked on top of one another in the ground and having an inner diameter of sufficient size to allow a person to descend into the rings to effect interconnection of the pipes and conduits. As cement rings of this kind are heavy to transport and position on top of the wall, which may be a drilled deep-well, and in addition they are rather bulky, particularly as the lid covering the uppermost cement ring always will be visible, attempts have been made to find new ways of eliminating these disadvantages.

In accordance with one suggested solution a steel well casing is used, which casing is inserted down into the well opening and is of such a length that the upper casing end reaches up to ground level. At a frost-free level, the well casing is provided with a lateral pipe socket or connecting branch to which is connected a pipe leading to the pump. A slide means is vertically displaceable inside the well casing and the ascending pipe is connected to the lower end of said slide means. The slide is displaceable in a guide provided on the inner face of the well casing, this displacing movement effected by means of a nut screwed on a vertically extending rod on the slide means. The rod extends all the way up to the upper end of the well casing, penetrating an end plate positioned at this end and above which the adjusting nut is provided. A disadvantage experienced with a coupling arrangement of this type is its tendency to become stuck whereby, when the ascending pipe and a valve or pump provided at the lower end thereof are to be pull up from the well opening for inspection and overhaul, it may be separated from the guide only with great difficulty. Because of the comparatively long and heavy steel well casing, the coupling device is difficult to handle and transport and the manufacturing costs are high.

SUMMARY OF THE INVENTION

The purpose of the present invention is primarily to eliminate the drawbacks outlined in the aforegoing. More precisely, the invention concerns couplings intended to removably interconnect, at a point below ground level, an ascending pipe inserted into a well and a pipe leading to a pump, said coupling comprising a coupling head having a lateral passage connected to the upper end of the ascending pipe and intended to sealingly abut against a seat connected to the pump pipe and provided on or in a well casing insertable into the well. It is characteristic of the invention that the coupling head is provided with a lateral connecting branch which is connected to the ascending pipe, and in that an eccentric in the form of, a cam member is rotatably mounted on the coupling head so as to be turnable by means of an actuating rod and arranged, when turned in one direction, to be urged against an abutment for displacement of the coupling head in the lateral direction until the connecting branch engages in and sealingly abuts against the seat.

With the aid of an arrangement of this kind it becomes possible to effect interconnection of the pipes in a comfortable manner from above ground level. An annular frame may easily be deposited at the well location in the conventional well casing, made for instance from rigid plastics and having dimensions fitting the well opening.

In accordance with a preferred embodiment, the eccentric cam member is arranged, when turned in the opposite direction by means of the actuating rod, to release the pipe coupling, whereby it then becomes possible to pull the coupling head together with the ascending pipe connected thereto up from the well with the use of said rod.

In accordance with a second preferred embodiment the actuating rod is arranged for turning movement inside a bearing sleeve which may be pivoted inside the casing in a vertical plane extending in the longitudinal direction of the connecting branch. One of the advantages gained by this arrangement is the possibility to turn the eccentric inside the well casing by means of the actuating rod, whereby interconnection of the connecting branch and the seat is effected, and also to pivot the bearing sleeve together with the actuating rod and the coupling head away from the seat to effect release. The latter coupling movement is achieved easily, e.g. by means of a pipe fitted onto the upper end of the bearing sleeve.

BRIEF DESCRIPTION OF THE DRAWINGS

Further characteristics and advantages obtained by the invention will become apparent upon reading of the following detailed description in conjunction with the accompanying drawings, wherein.

DETAILED DESCRIPTION OF PREFERRED EMBODIMENTS

Figure 1:
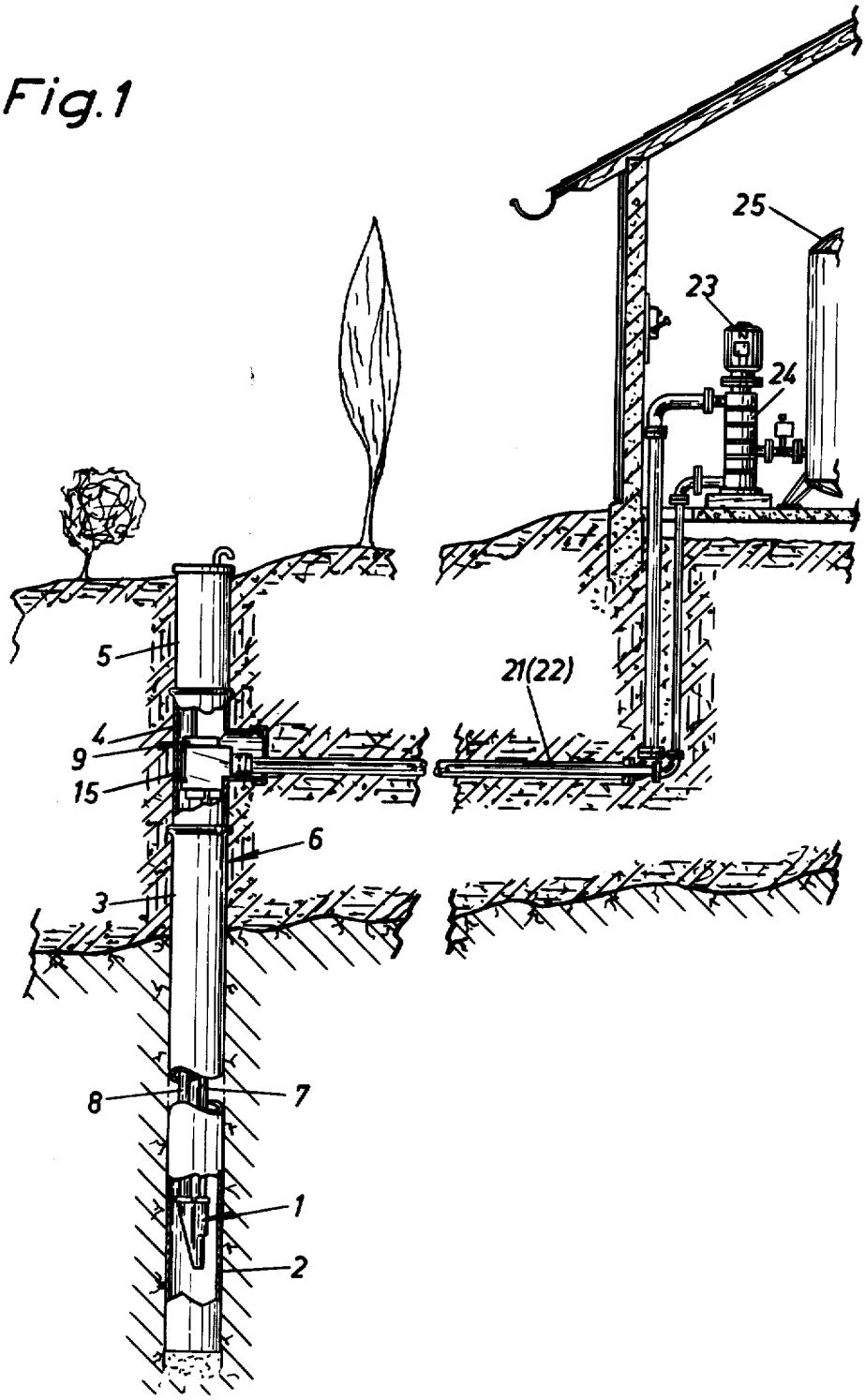
FIG. 1 illustrates schematically a vertical section through a pump installation equipped with a coupling device in accordance with the invention.
Figure 3:
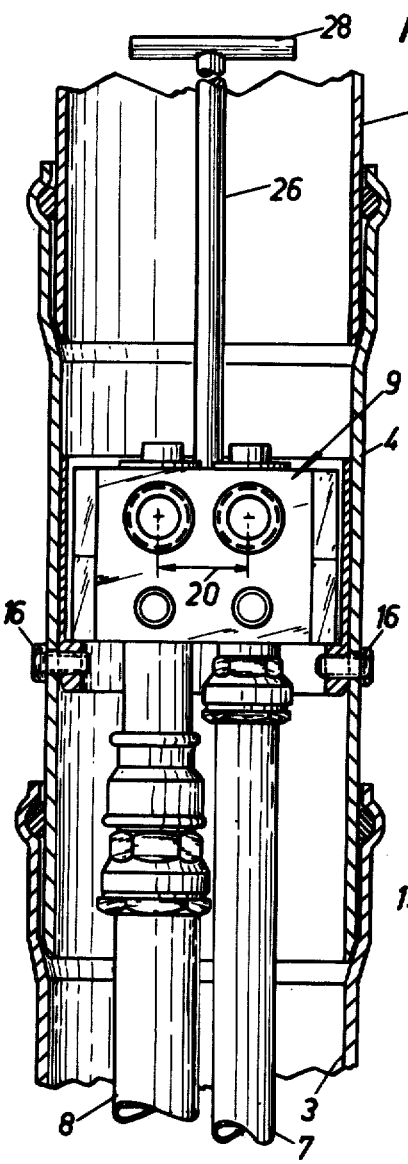
FIG. 3 illustrates a vertical sectional view through the well casing and an end view of the coupling device.

The installation illustrated in the drawings comprises an ejector 1 inserted into the well opening 2, below the water level therein. Into the upper end of the well opening 2 is inserted a well casing 6 comprising several sections 3, 4, and 5. Two hoses 7, 8 are connected to the ejector 1, one 7 serving as a pressure pipe and the other one 8 serving as an ascending pipe carrying the well water. The hoses 7, 8 are connected at their upper ends to a coupling head 9 having lateral passages 10, 11 which are connected to their respective hose 7, 8. Into each passage 10, 11 is screwed a connecting branch 12, 13 each one of which is provided with an annular seal 14. In accordance with the embodiment illustrated in FIGS. 2 - 5 the coupling head is arranged to be inserted into an annular frame 15 which by means of screws 16 is secured inside casing section 4 which is in the shape of a T-member. The frame 15 has a lateral wall 17 in which are formed two seats 18, 19 spaced apart by a horizontal distance 20 (FIG. 3) which coincides with the spacing between the connecting branches 12, 13. To each seat 18, 19 is connected a pipe line 21 and 22, respectively, leading to the two ends of a pump 24, driven by an electric motor 23. The pump communicates with a liquid elevator 25.

An actuating rod 26 is rotatably mounted on the coupling head 9, the lower end of said rod having an eccentric cam member 27 secured thereto. The rod 26 is provided at its upper end with a cross piece 28 serving as a cock handle. The eccentric cam member 27 is formed with a curved outer race of such an arcuate curvature that the distance of the race from the rod 26 increases in the direction towards the free end 30 of the eccentric cam, said distance increasing gradually less the closer it is to the free end of the cam. The eccentric cam member 27 cooperates with a flat abutment 31 provided internally in the frame 15. The dimensions of the coupling head are so chosen that when the eccentric cam is turned into its inner position illustrated in FIG. 4, the distance 32 between the free ends of the connecting branches 12, 13 and the extreme outer point of the cam race 29 is less than the distance 33 between the wall 17 and the abutment 21. This makes it possible to insert the coupling head 9 together with the hoses 7, 8 and the ejector 1 until the coupling head 9 rests on an annular internal shoulder 34 provided at the lower end of the frame 15. In this position, the connecting branches 12, 13 are exactly opposite the seats 18, 19.

Figure 4:
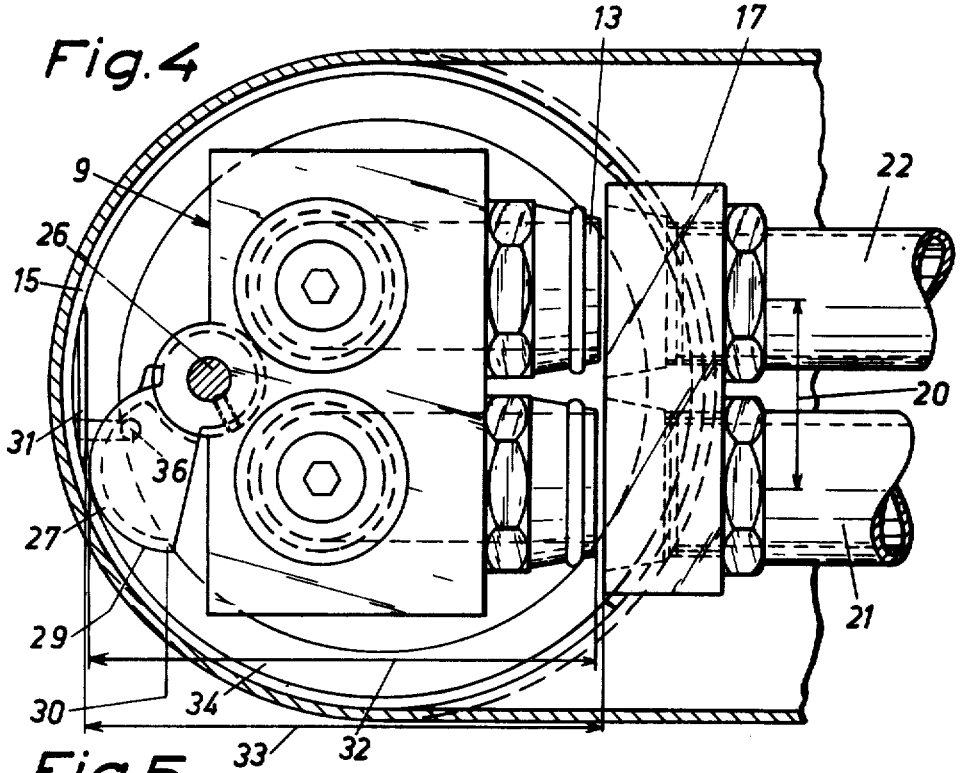
FIG. 4 is a plan view of the coupling device inserted into the annular frame immediately prior to interconnection of the pipes.

During the inserting operation, the cross piece 28 on the rod 26 serves as a comfortable handle. When the eccentric cam member is thereafter turned by means of the rod, clockwise as seen in FIG. 4, to the position shown in continuous lines in FIG. 5, the coupling head 9 is displaced by the eccentric cam 27 laterally (to the right in accordance with FIG. 5), whereby the connecting branches 12, 13 will engage the seats 18, 19, with their annular seals 14 sealingly abutting against the seats. The interconnection is now completed and on account of the configuration of the eccentric cam 27 the coupling engagement is irreversible.

Figure 2:
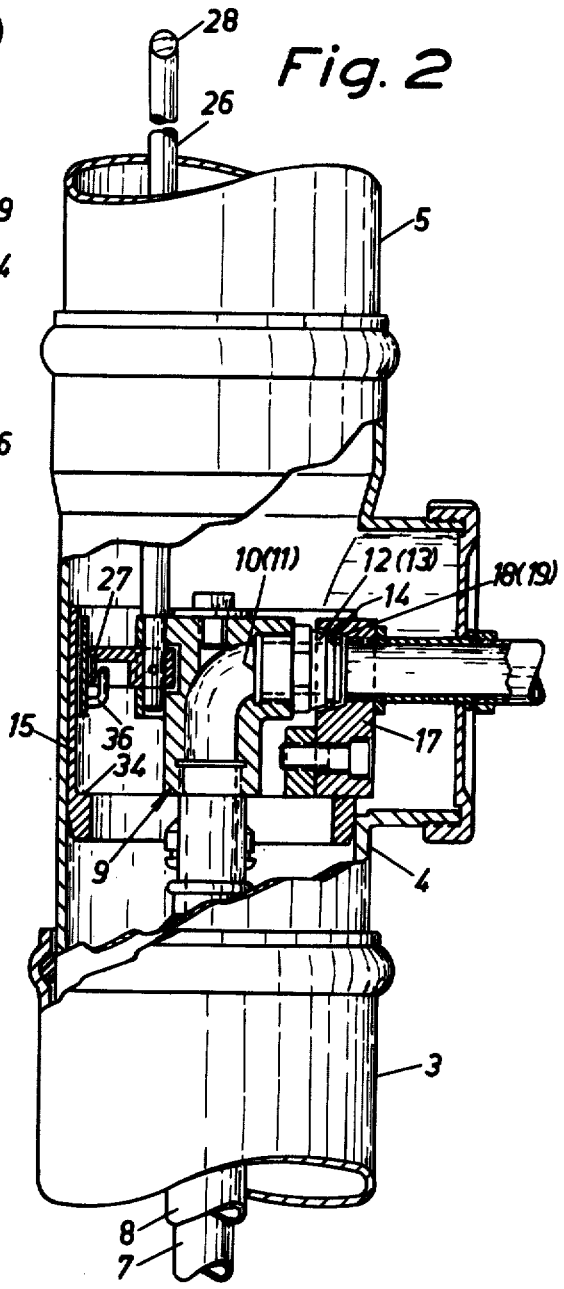
FIG. 2 illustrates on an enlarged scale a side view of a part of the well casing including a vertical section through the coupling device.
Figure 5:
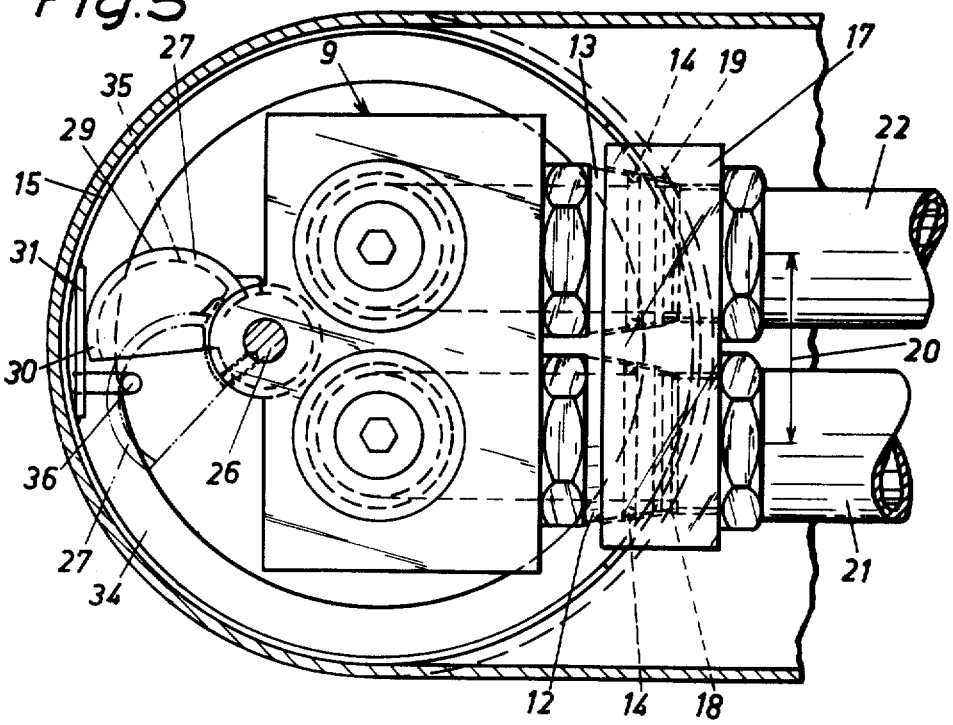
FIG. 5 is a similar view after such interconnection.
Figure 6:
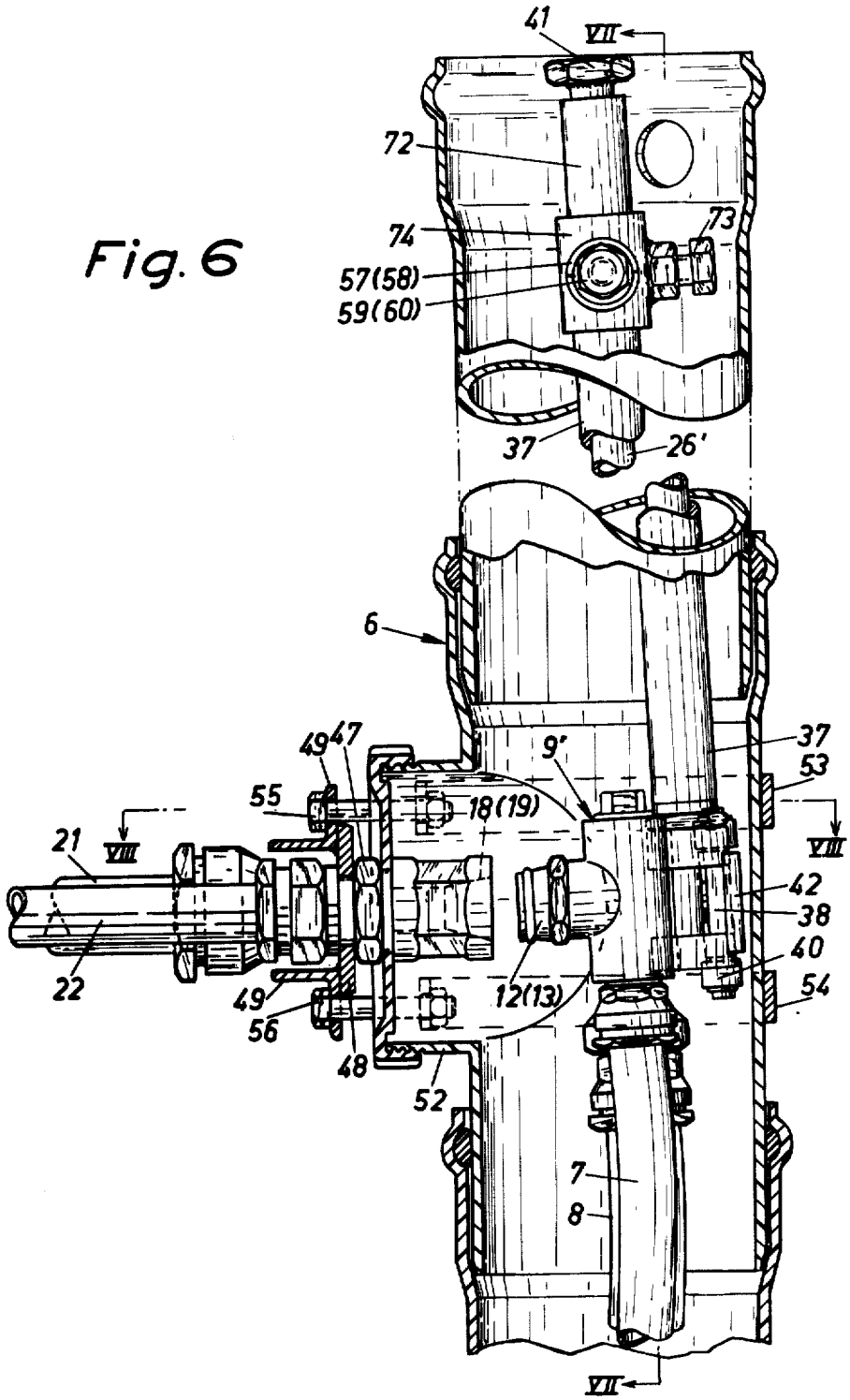
FIG. 6 is a vertical longitudinal sectional view through the well casing, illustrating the coupling device in release position in accordance with a second embodiment.
Figure 7:
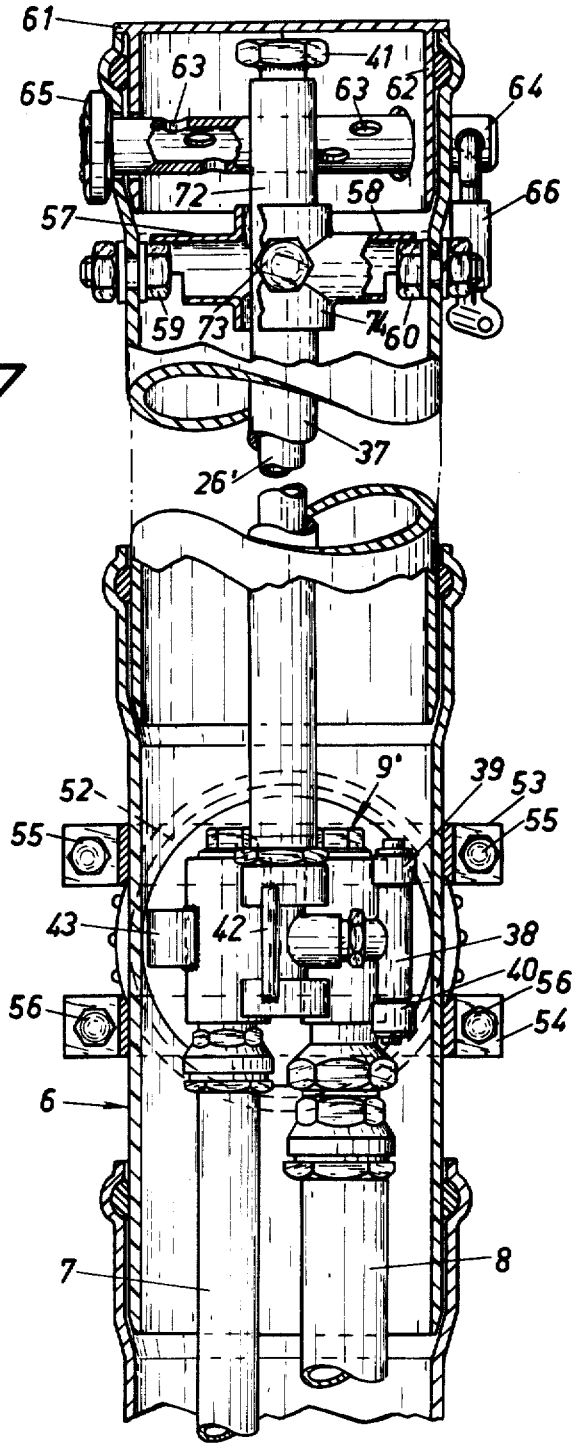
FIG. 7 is a vertical longitudinal sectional view through this well casing along line VII—VII of FIG. 6.

As illustrated in FIGS. 2, 4, and 5 the eccentric cam member 27 is in the shape of a downwardly directed flange. It is likewise formed with an internal race 35 extending essentially in parallel with the external race 29. Internally of the inner race 35 projects upwards a shoulder or pin 36 on the frame 15 (FIG. 2).

Owing to this arrangement it becomes possible, upon demand, to release the pipe coupling comfortably. All that needs to be done is to turn the eccentric cam member 27 counter-clockwise as seen in FIG. 5 (i.e. in the opposite direction to before) with the aid of the cross piece 28 and the rod 26, whereby the inner race 35 of the eccentric cam will slide along the pin 36 and thus force the coupling head 9 to the left, to the position illustrated in FIG. 4. The coupling head 9, together with the hoses 7, 8 and the ejector 1, may now be pulled up from the well opening by means of the rod 26 for inspection and overhaul.

In accordance with the embodiment illustrated in FIGS. 6 to 9 the frame 15 is replaced by a support structure for the seats 18, 19, secured on the external face of the well casing 6.

From the coupling head 9' supporting the connecting branches 12, 13 which are connected to the house 7, 8 extends upwards a bearing sleeve 37 which is rigidly secured to the coupling head and in which the actuating rod 26' is rotatably mounted. The eccentric means is provided at the lower rod end, said means consisting in this embodiment of an arm 38, arranged in parallel with the actuating rod and at a certain distance therefrom, said arm supporting at its upper and lower ends rolls 39, 40, respectively, intended to be in contact with the internal face of the well casing 6. At its upper end, the actuating rod 26' is provided with a head 41 which has a non-round cross-sectional configuration, and in order to turn the actuating rod 26' and the eccentric arm 38 it may be gripped by a key fitting the head. The coupling head 9' is provided with a shoulder 42 so as to stop the eccenter arm 38 in the interconnected position. The eccentric head 9' is also provided with a guide shoulder 43 which, in conjunction with the internal face of the well casing 6, guides the coupling head and thus facilitates insertion of the connecting branches 12, 13 into their respective one of seats 18, 19 on the pipes 21, 22.

The pipe sockets 44, 45 in which the seats 12, 13 are formed, are by means of a threaded nipple 46, 47 attached to a plate 48 on two transverse retainer irons 49. The nipples 46, 47 pass through holes 50 formed in a lid 51 closing a lateral branch 52 on the well casing 6. Two traction belts 53, 54 extending about the well casing 6 and secured by means of bolts 55, 56 to the transverse retainer irons 49 take the pressure stresses generated by the eccentric arm 38 during the interconnection.

Close to its upper end the bearing sleeve 37 is provided with two coaxial, downwardly open bearing cups 57, 58 which, upon insertion down into the well casing 6 of the unit comprising the coupling head 9' including the hoses 7, 8, the bearing sleeve 37, the eccentric arm 38, and the actuating rod 26', may be forced to grip over two support pins 59, 60 positioned opposite one another and engaging the well casing.

The well casing 6 is closed at its upper end by a lid 61 having a rim 62 engaging the well casing and through which rim and the well casing wall passes a pipe 64 in which air through-passage openings 63 are formed. One end of said pipe has an annular head 65 whereas the opposite end thereof is passed through by a padlock 66. In this manner unauthorized access to the interior of the well casing 6 and to the well is prevented.

Figure 8:
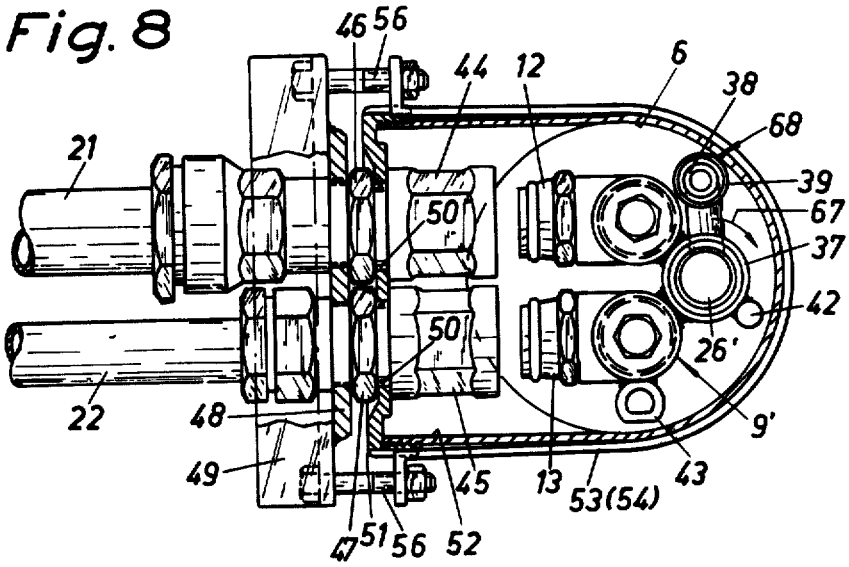
FIG. 8 illustrates a transverse section through the coupling device along line VIII—VIII in FIG. 6.

The function is as follows. After removal of the lid 61, the unit comprising the coupling head 9' with its associated hoses 7, 8, and connecting branches 12, 13, as well as actuating rod 26' together with its eccenter arm 38 and bearing sleeve 37 including bearing cups 57, 58 is inserted down into the well casing 6 and is suspended therein in such a manner that the bearing cups 57, 58 rest on the support pins 59, 60 and the connecting branches will be directed towards the seats 18, 19. When the actuating rod 26' is thereafter turned in the direction indicated by arrow 67 in FIG. 8 by means of a key (not shown) gripping the head 41, the eccentric arm 38 will move, whereby its rollers 39, 40 will come into contact with the inner faces of the well casing 6, for instance at the point designated 68 in FIG. 8. Upon continued turning of the actuating rod 26' the rollers 39, 40 on the eccentric arm 38 slides against the inner face of the pipe casing 6, thus pivoting the bearing sleeve 37 about the support pins 59, 60 in the clockwise direction as seen in FIG. 8, such that the connecting branches 12, 13 engage their associated seat 18, 19, whereby the interconnection is effected. As appears from FIG. 9, the stop shoulder 42 limits the movement of the eccentric arm 38 at a point 69 inside the well casing 6, positioned at a distance 70 past the point 61 which is diametrically opposite the seats 18, 19. Thus irreversible locking of the eccentric means is achieved.

Figure 9:
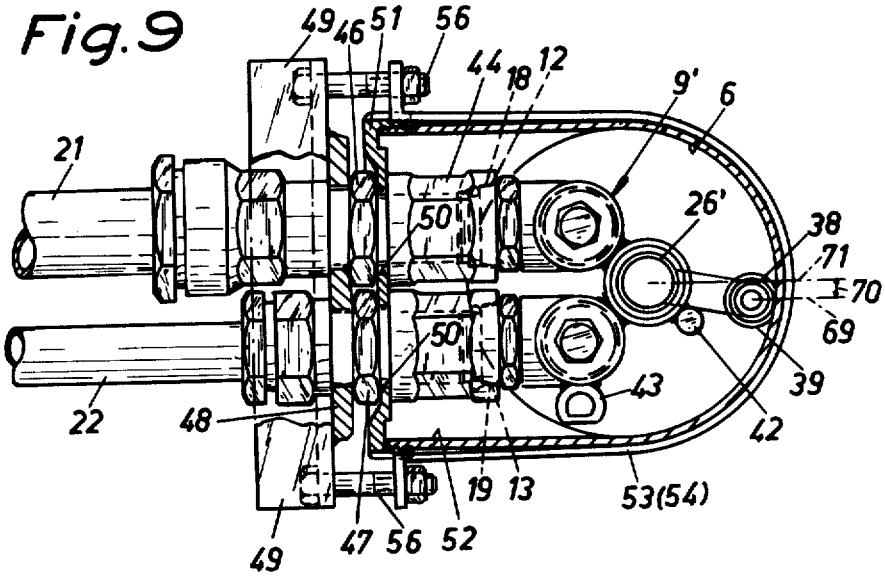
FIG. 9 illustrates a simial sectional view but with the coupling in the engaged position.

Release is effected in the following manner. The actuating rod 26' is turned by means of the key in the opposite direction — counter-clockwise as seen in FIG. 9 — to the position illustrated in FIG. 8. After fitting of an extension pipe (not shown) over the end 72 of the bearing sleeve 37 projecting above the bearing cups 57, 58, the bearing sleeve 37 is pivoted by means of the extension pipe about the support pins 59, 60 in the counter-clockwise direction to the position illustrated in FIG. 6, wherein the connecting branches 12, 13 are pulled out of contact with the seats 18, 19. Then, the entire unit — coupling head 9', hoses 7, 8, bearing sleeve 37, etc. — may be extracted from the well casing 6 for inspection and overhaul, if needed.

As appears from the drawings, the entire coupling device may be assembled from standard pipe parts, angle rods, bends and band irons and so on, whereby the device becomes comparatively cheap in manufacture.

By means of a clamping screw 73 a sleeve 74 supporting the bearing cups 57, 58 may be clamped to the bearing sleeve 37 at a distance from the coupling head 9' which is sufficient to allow the connecting branches 12, 13 to be positioned at exactly the same level as the seats 18, 19.

The embodiments as described and illustrated are to be regarded as examples only and the pipe coupling may be constructively altered in a variety of ways within the scope of the appended claims. The release mechanism may be completely dispensed with. The pipe coupling may find application in other well installations than those including an ejector. When the suction elevation is less than 9 meters an ascending pipe provided with a bottom valve only need be used and a simple water pump be used above ground. The rod 26 may be replaced by a flexible shaft.

What I claim is:

1. In a well having a well casing inserted therein, an improved coupling arrangement for removable interconnection, at a point below ground level of a vertically extending pipe inserted into said well and a pipe leading to a pump, said coupling comprising a coupling head, a lateral passage in said coupling head, said lateral passage being adapted to be connected to the upper end of said vertically extending pipe, a seat connected to said pump pipe and adjacent said lateral passage, said lateral passage being adapted to sealingly abut against said seat, the improvement comprising a lateral connecting branch provided on said coupling head adapted to be connected to said vertically extending pipe, an eccentric mounted on said coupling head for rotation about a vertically extending axis, an actuating rod operably connected to said eccentric to effect turning movement of said eccentric, said actuating rod being adapted to extend vertically through said coupling head and having an upper portion positioned adjacent the ground level for actuation, said eccentric arranged, when turned in one direction, to be urged against an abutment so as to displace said coupling head in the lateral direction until said connecting branch thereon engages in and sealingly abuts against said seat.

2. An improved coupling arrangement as claimed in claim 1, wherein said eccentric is a cam member and wherein an annular frame is provided inside said well casing, said frame having an upright member formed thereon, the cam member having a cam surface arranged to cooperate with said upright member for operating said coupling head upon turning of said cam member in the opening direction to a position wherein said connecting branch thereon recedes from its said associated seat and said coupling head together with its vertically extending pipe may be pulled up from said well casing.

3. An improved coupling arrangement as claimed in claim 1, wherein said actuating rod supports a cross piece at its upper end, said piece serving as a cock handle.

4. An improved coupling arrangement as claimed in claim 1, comprising a bearing sleeve, said bearing sleeve supporting said actuating rod for turning movement therein, said sleeve being pivotable inside said well casing in a vertical plane extending in the longitudinal direction of said connecting branch of said coupling head.

5. An improved coupling arrangement as claimed in claim 4, comprising diametrically opposite bearing cups formed on said bearing sleeve, said cups open in the downwards direction and arranged, upon insertion down into said well casing of said coupling head, said eccentric, said actuating rod, and said bearing sleeve, which means are assembled into one removable unit, to engage two support pins positioned coaxially at the same level in the interior of said well casing.

6. An improved coupling arrangement as claimed in claim 5, wherein said eccentric is in the form of an arm, said arm being rigidly connected to the lower end of said actuating rod in a position at a distance from and in parallel with said rod, said arm arranged, upon turning movement of said actuating rod, to move into abutment against the inner face of said well casing at a point positioned at a distance from a point on said well casing that is diametrically opposite said connecting branch.

7. An improved coupling arrangement as claimed in claim 4, comprising a support structure positioned externally of said well casing and having said seat attached thereto, said support structure retained to said well casing by means of traction bands engaging said casing.

* * * * *